United States Patent [19]

Shimoyama et al.

[11] 4,375,283

[45] Mar. 1, 1983

[54] METHOD OF CONTROLLING TENSIONS IN CONTINUOUS ANNEALING FURNACE AND SYSTEM THEREFOR

[75] Inventors: Yuji Shimoyama; Fumiya Yanagishima; Hiromasa Yamamoto; Gunji Sakamoto, all of Chiba, Japan

[73] Assignee: Kawasaki Steel Corp., Hyogo, Japan

[21] Appl. No.: 200,326

[22] Filed: Oct. 24, 1980

[30] Foreign Application Priority Data

Oct. 31, 1979 [JP] Japan ..... 54-141502

[51] Int. Cl.[3] ..... C21B 13/00

[52] U.S. Cl. ..... 266/44; 266/78; 266/102; 266/111; 432/8

[58] Field of Search ..... 266/44, 78, 102, 103, 266/111, 251, 252, 259, 274; 226/1, 6, 8, 104, 107, 118, 119; 432/8, 59, 60; 242/75.3

[56] References Cited

U.S. PATENT DOCUMENTS 2,666,003 1/1954 Dougherty et al. ..... 432/59
2,967,007 1/1961 Baughman ..... 226/118
2,980,561 4/1961 Ford et al. ..... 432/59
3,109,572 11/1963 Herr ..... 226/119
3,385,946 5/1968 Hatchard ..... 432/8
4,202,476 5/1980 Martin ..... 242/75.3

FOREIGN PATENT DOCUMENTS 52-30928 8/1977 Japan .

*Primary Examiner*—John P. Sheehan
*Attorney, Agent, or Firm*—Koda and Androlia

[57] ABSTRACT

Helper rolls in a continuous annealing furnace are divided by a master speed hearth roll serving as the boundary into a plurality of control blocks disposed forwardly and rearwardly of the master speed hearth roll, and the speed of rotation of the master speed hearth roll is used as a reference speed. Tension of a steel strip are continuously controlled on the basis of values detected by a tension meter in the plurality of control blocks towards the inlet of the furnace for the helper rolls disposed forwardly of the master speed hearth roll and towards the outlet of the furnace for the helper rolls disposed rearwardly of the master speed hearth roll.

2 Claims, 4 Drawing Figures

METHOD OF CONTROLLING TENSIONS IN CONTINUOUS ANNEALING FURNACE AND SYSTEM THEREFOR

BACKGROUND OF THE INVENTION

1. Field of the Invention

The present invention relates to a method of controlling tension in a continuous annealing furnace provided therein with tension control means, and a system therefor.

2. Description of the Prior Art

Recently, annealing processes for rendering predetermined processability, deep drawing properties and the like to cold-rolled steel strips have been carried out by continuous annealing furnaces. These continuous annealing furnaces each comprise a heating zone for heating the steel strip to a predetermined temperature, a soaking zone for holding the steel strip at a predetermined soaking temperature and a cooling zone for cooling the steel strip to substantially room temperature. The cooling zone further includes a rapid cooling zone for rapidly cooling the steel strip at a predetermined cooling rate, a slow cooling zone for slowly cooling the steel strip or holding same at a predetermined temperature to effect overaging treatment, and the like. Consequently, the above-described continuous annealing furnace generally forms a long continuous line, and therefore, it is necessary to render appropriate tension to the steel strip in the furnace in order to maintain stabilized operating conditions in the furnace.

FIG. 1 is an explanatory view showing a general example of the conventional continuous annealing furnace. As shown in FIG. 1, the continuous annealing furnace comprises a heating zone 1, a soaking zone 2, a first cooling zone 3, a second cooling zone 4, and a third cooling zone 5, bridle rolls 6*a*, 6*b* are provided in front and behind the furnace, and further, a tension control unit 7 is interposed between the bridle roll 6*a* and the heating zone 1. A steel strip 10 is loaded in order of the zones in the abovedescribed arrangement, and subjected to heat treatment. Namely, the steel strip is heated to a predetermined temperature in the heating zone 1, held at a predetermined temperature in the soaking zone 2, thereafter, passes through the first cooling zone 3, the second cooling zone 4 and the third cooling zone 5 while being successively cooled. The cooling rates in the respective cooling zones may be varied depending upon the compositions of the steel strip material to be treated and the intended characteristics of the material quality thereof.

Now, to control the steel strip tension in the furnace in this conventional example, tensions of the steel strip at the inlet and the outlet of the furnace are generally set. The actual adjustment of the tension is performed by means of a dancer roll provided between the bridle rolls disposed at the inlet of the furnace and the outlet of the furnace and with this arrangement the tension of the steel strip in the respective blocks in the furnace is not controllable. Consequently, proper tension has not been given to the steel strip in the respective cooling zones, thus presenting problems such as buckling in a non-aligned fashion, and slip, all of which are caused by unfitness and instability in tension of the steel strip. In order to obviate such problems, for example, in Japanese Patent Application Publication No. 30928/77, there has been disclosed such a method that the interior of a continuous heat treating furnace is divided into a plurality of blocks, and tension on the steel strip in the respective blocks are controlled in association with tension of the steel strip in the preceding and succeeding blocks. Namely in FIG. 1, tension meters 8*a*, 8*b*, 8*c*, 8*d* and 8*e* are provided in the furnace for detecting the tension of the respective sections of the steel strip. Output signals of tension meters represent the detected tensions in the respective sections, and are fed to steel strip tension control means 9*a* and 9*g* for controlling motors TM and M1 to M20. Each of the motors M1 to M19 drives each helper roll H1 to H19 for guiding the steel strip, individually from each other. The torque motor TM operates the tension control unit 7, and the motor M20 operates the bridle rolls 6*b*. The bridle rolls 6*a* are operated by a motor M21. More specifically, output signals from the tension meter 8*a* are fed to the steel strip tension control means 9*a*, 9*b* and 9*c*, outputs from the tension meter 8*b* to the steel strip tension control means 9*b*, 9*c* and 9*d*, outputs from the tension meter 8*c* to the steel strip tension control means 9*c*, 9*d* and 9*e*, outputs from the tension meter 8*d* to the steel strip tension control means 9*d*, 9*e* and 9*f*, and outputs from the tension meter 8*e* to the steel strip tension control means 9*e*, 9*f* and 9*g*. As described above, the respective tension meters feed their outputs to the groups of the steel strip tension control means of the block in question and the groups of the steel strip tension control means in the blocks preceding and succeeding the block in question. In addition, the tension command signals $TS_1$ to $TS_5$ are fed to the respective steel strip tension control means 9*b* to 9*f* for setting optimum tension in the respective sections of the steel strip. Furthermore, a tension setting signal TSC for setting the tension of the tension control unit 7 is fed to the steel strip tension control means 9*a* for driving the tension control unit 7.

In the arrangement of FIG. 1, deviation of tensions value between the detected tension value and the set tension value are obtained for each zone in the furnace, and the deviation tension values thus obtained are combined with detected tension values in the preceding and succeeding zones or a detected tension value in the preceding or succeeding zone to be used for controlling the torque of a motor or motors for a roll or rolls. With the arrangement as described above, it becomes possible that a preset distribution of tension in the furnace is maintained and the set tension values in the respective zones in the furnace can be automatically switched successively or simultaneously.

Nevertheless, the conventional control means present the following disadvantages.

(1) In the case a line speed, which is given as the master speed for the furnace, is based on the bridle roll 6*b*, the speed of the bridle roll 6*b* at the outlet of the furnace is varied depending upon the tension of the steel strip of the final cooling zone, whereby the speed of the bridle unit at the outlet is varied.

(2) Since a tension command signal for each zone is calculated from the detected tensions of the steel strip in the preceding and/or succeeding zones, the change of the tension command signal in a given zone affects the tension command signals in other zones, whereby the tension control is not stabilized. Also a fluctuation in deflection between the set value and the detected value of the tension affects the tension command signals in whole of the zones.

(3) Since the steel strip is given tension a high temperature in the heating and soaking zones, the steel strip is elongated due to plastic deformation depending upon the dimensions and temperature of the steel strip.

In this case, in principle, it suffice to hold the tension only in the heating zone and soaking zone at proper values. However, in the example shown in FIG. 1, the control of tension in the blocks preceding and succeeding the block in question, which are principally irrelevant to the block in question, are subject to the influence of the tension in the block in question, so that a stable tension cannot be obtained. Particularly, the influence is high in the case of the materials to be annealed at high temperature. For this reason, even in the case proposed as above, such problems have not been obviated as the movement in a non-aligned fashion, buckling, slip and the like of the steel strip, all of which are caused by unbalance in tension generated in the steel strip.

SUMMARY OF THE INVENTION

The present invention has as its object the provision of a method of controlling tension of a steel strip in a furnace, wherein the speed of a continuous annealing line is controlled on the basis of a master speed hearth roll provided in the furnace, and the tension of the steel strip is continuously controlled towards both the inlet and outlet of the furnace from the master speed hearth roll as the boundary.

The present invention contemplates to achieve the abovedescribed object in such a manner that a master speed hearth roll provided at a predetermined position in a continuous annealing furnace is driven at a preset speed, on the basis of which the speed of the continuous annealing line is controlled, the master speed hearth roll insulates the tension of the steel strip in front of the master speed hearth roll from the tension of the steel strip behind the master speed hearth roll so that the inside of the furnace is divided into a plurality of tension control blocks. All of the signals including steel strip tension detecting signals for self-control blocks through steel strip tension detecting signals for control blocks adjacent to the master speed hearth roll are applied to tension control means provided corresponding to the respective control blocks, and tensions of a steel strip in the plurality of control blocks is continuously controlled in sequence towards both the inlet and outlet of the furnace from the master speed hearth roll.

BRIEF DESCRIPTION OF THE DRAWINGS

The abovementioned features and object of the present invention will become more apparent by reference to the following description taken in conjunction with the accompanying drawings, wherein like referenced numerals denote like elements, and in which.

DETAILED DESCRIPTION OF THE INVENTION

Here, the speed of the master speed hearth roll, serving as the reference of the speed, is set so as to satisfy the following conditions. Namely, the master speed hearth roll is set to serve as the boundary which divides the interior of the furnace into two regions for controlling the tension of the steel strip including one region in which elongation of the steel strip due to thermal expansion or due to plastic deformation caused by the tension of the steel strip in the furnace and an other region in which thermal shrinkage due to cooling is generated and elongation due to plastic deformation caused by the tension of the steel strip is very small in value. More specifically, in the case of the continuous annealing furnace, since the speed is controlled in the respective zones in most cases, it is desirable to provide the master speed hearth roll at a portion where the steel strip is at high temperature of about 400° C. or above, for example, the boundary between the soaking zone and the rapidly cool zone. Furthermore, it is desirable to control the master speed hearth roll in a manner that the master speed hearth roll is formed to be a dull roll having an average surface roughness of 1 to 7 microns to thereby increase the coefficient of friction with the steel strip.

Figure 1:
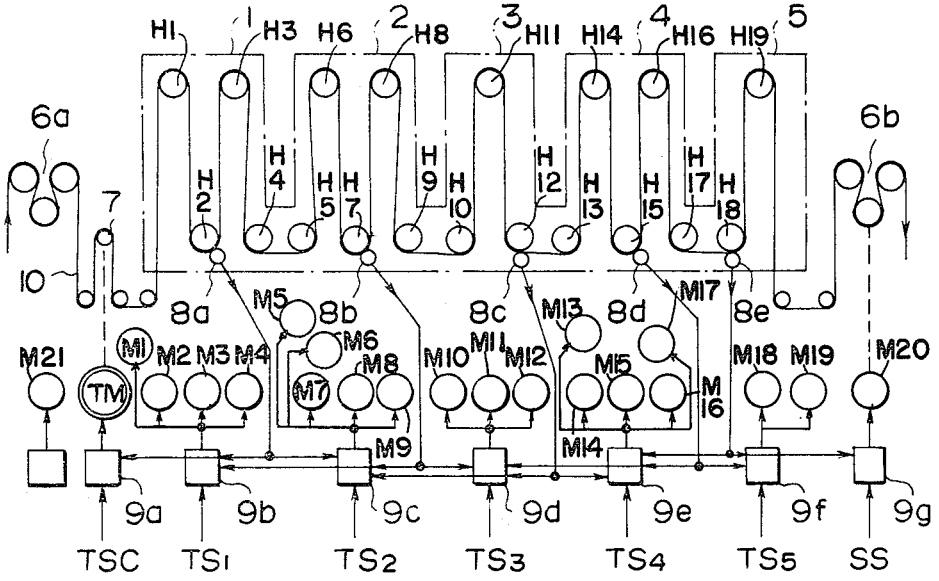
FIG. 1 is a block diagram showing the steel strip tension control means in the conventional continuous annealing furnace.
Figure 2:
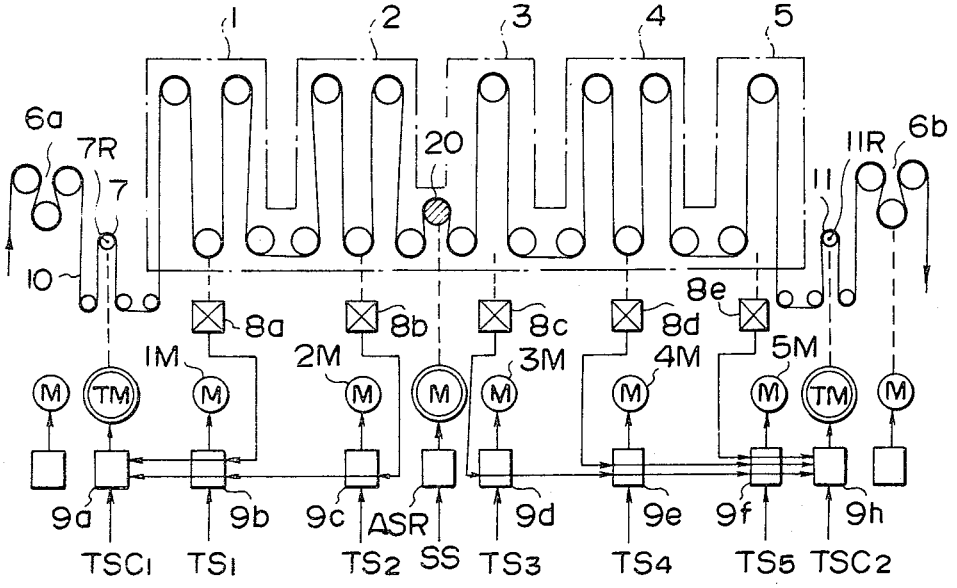
FIG. 2 is a block diagram showing one embodiment of the present invention.

FIG. 2 is a block diagram showing a preferred embodiment of the present invention. The arrangement of the furnace shown in FIG. 2 is similar to that illustrated in FIG. 1, and therefore, a detailed description will be omitted.

As shown in FIG. 2, for example, a master speed hearth roll 20 controlled by an automatic speed regulator (ASR) and serving as the reference for the line speed is provided at the center of the furnace, i.e., between a soaking zone 2 and a first cooling zone 3, and further, a tension control unit 11 is provided at the outlet of furnace. Furthermore, tension meters 8*a* through 8*e* are provided in the respective zones of the furnace, and control blocks are provided forwardly and rearwardly of the master speed hearth roll 20 serving as the boundary. More specifically, an output from the tension meter 8*a* is fed to steel strip tension control means 9*a* and 9*b*, and an output from the tension meter 8*b* is fed to steel strip tension control means 9*a*, 9*b* and 9*c*. While, an output from the tension meter 8*c* is fed to steel strip tension control means 9*d*, 9*e*, 9*f* and 9*h*, and output from the tension meter 8*d* is fed to steel strip tension control means 9*e*, 9*f* and 9*h*, and further, the output from the tension meter 8*e* is fed to steel strip tension control means 9*f* and 9*h*. Output signals from position detectors, (not shown) provided in tension control unit 7 and 11, are adapted to control dancer rollers 7R and 11R of the tension control units 7 and 11 to settle in place.

Tension command signals $TS_1$ to $TS_5$ similar to those in the prior art are fed as the command values to the steel strip tension control means 9*b* 9*f*, and tension setting signals $TSC_1$ and $TSC_2$ are fed as the command values to the steel strip tension control means 9*a* and 9*h* for controlling torque motors TM. Furthermore, a line speed setting signal SS is fed to the abovedescribed ASR.

If the tension changes, e.g., the tension of the steel strip in the first cooling zone decreases, under the normal condition of the tension control, the tension command signal TS3 is first of all changed. This change causes a deviation in value between the output from the tension meter 8*c* and the tension command signal $TS_3$. The tension control is fed back to the steel strip tension control means 9*d*, d*e*, 9*f* and 9*h* at a preset gradient in proportion to the deviation value. As a result, motors 3M, 4M and 5M for driving helper rolls in the first, second and third cooling zones 3, 4 and 5 are decreased in rotational speed, the output of the torque motor TM for the tension control unit 11 is decreased, and the tension of the steel strip in the first cooling zone 3 is decreased. At this time, the dancer roll 11R of the tension control unit 11 is raised, however, an output from the position detector of the dancer roll 11R increases the speed of the bridle roll 6*b*, to thereby control the dancer roll 11R to settle in place. As described above, the tension forwardly and rearwardly of the master speed hearth roll 20 are continuously controlled on the basis of the master speed hearth roll 20. The master speed hearth roll 20 functions only as the reference for speed and is separated from a system of controlling the tension and hence, there occurs no interference therebetween. In addition, the basic patterns of tension are developed by optionally setting the tension command signals TS1 to TS5 independently from each other.

Figure 3:
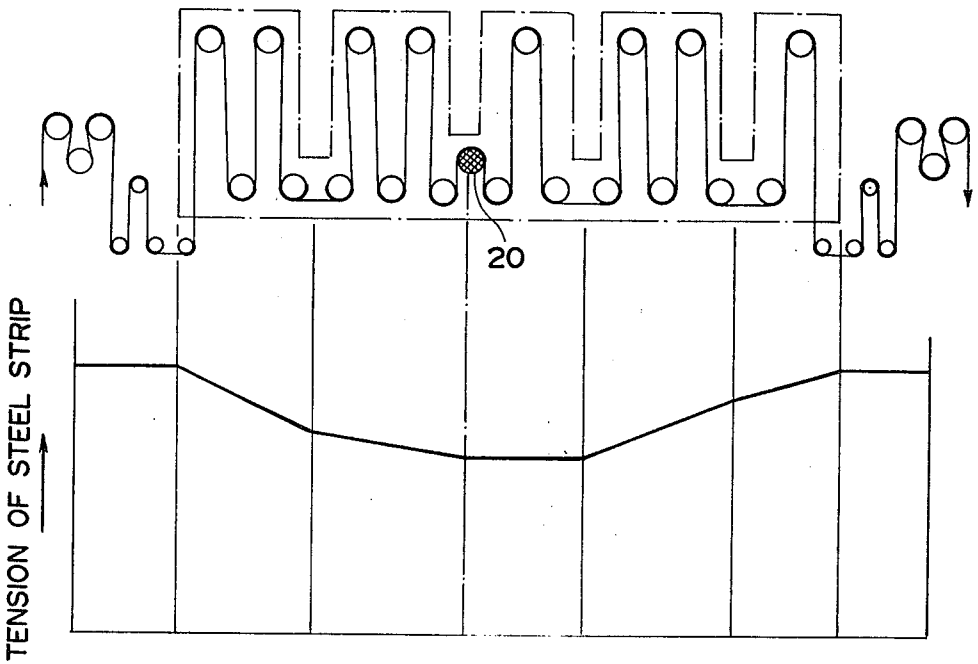
FIG. 3 is a characteristic curve diagram showing the tension of the steel strip in the embodiment in FIG. 2.

FIG. 3 is a characteristic curve diagram of the steel strip in the embodiment shown in FIG. 2.

It is apparent from FIG. 3 that the tension of the steel strip is varied from the master speed hearth roll 20 as the boundary toward both the inlet and the outlet of the furnace, thereby providing a stabilized control. In the example shown in FIG. 3, the varied values of tension of the steel strip range from 0.4 $kg/mm^2$ to 2.0 $kg/mm^2$ depending upon the sheet thickness, grade of steel, line speed and the like.

Figure 4:
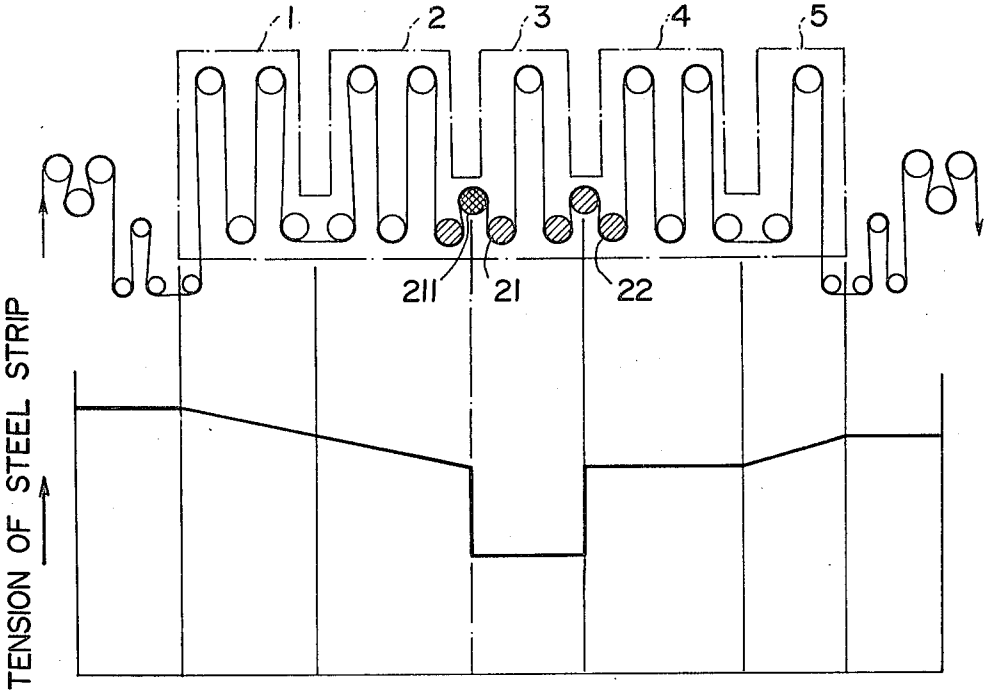
FIG. 4 is a characteristic curve diagram showing the arrangement of the furnace and the tension of the steel strip in another embodiment of the present invention.

FIG. 4 shows another embodiment of the present invention showing the continuous annealing furnace in which bridle devices for controlling the tension of the steel strip are provided both at the inlet and the outlet of the first cooling zone 3 and the tension of the steel strip in the first cooling zone 3 only can be decreased by both bridle devices at the inlet and the outlet of the first cooling zone 3. A roll 211 disposed at the center in a bridle device 21 provided at the inlet of the first cooling zone 3 is selected as the roll for the reference speed (corresponding to the master speed hearth roll 20), and the control of tension of the steel strip is effected towards both the inlet and the outlet of the furnace from the roll 211 at the center as the boundary. In this case, a bridle device 22 at the outlet of the first cooling zone functions as a boundary of control blocks as well. Except for the arrangement of these bridle devices, the method and arrangement for controlling the tensions of the steel strip in the respective zones of the furnace are identical with those shown in the embodiment of FIG. 2, and therefore, their illustration and description will be omitted. In addition, in the case the temperature of the steel strip at the outlet of the first cooling zone 3 is 400° C. or above, one of the rolls in the bridle device 22 at the outlet may be selected as the roll for the reference speed.

According to the present invention, the adverse effects in fluctuation of the tension of the steel strip due to the thermal expansion and elongation caused by the plastic deformation of the steel strip are eliminated, so that stabilized control of tension of the steel strip can be effected, thereby avoiding movement in a non-aligned fashion, buckling, slip and the like of the steel strip.

It should be apparent to one skilled in the art that the abovedescribed embodiment is merely illustrative of but a few of the many possible specific embodiments which can represent the applications of the principles of the present invention. Numerous and varied other arrangements can be readily devised by those skilled in the art without departing from the spirit and scope of the present invention.

What is claimed is:

1. A method of controlling tensions of a steel strip in the heating, soaking and at least one cooling zones in a continuous annealing furnace of the type including helper rolls in each of the heating, soaking and cooling zones for guiding the steel strip and tension controllers provided at an input and output of said continuous annealing furnace, said method comprising:

providing a master speed hearth roll at a predetermined position between the helper rolls of the soaking zone and the helper rolls of the cooling zone, said master speed hearth roll acting as a boundary between said heating and soaking zones and said cooling zone;

controlling a speed of said steel strip by controlling a speed of rotation of said master speed hearth roll to be a preset value;

sensing a tension of said steel strip in each of said heating, soaking and cooling zones;

controlling a tension on said steel strip in said heating and soaking zones and said tension controller at said input of said continuous annealing furnace in response only to said sensed tension in said heating and soaking zones; and controlling a tension on said steel strip in said cooling zone and said tension controller at said output of said continuous annealing furnace in response only to said sensed tension in said cooling zone.

2. A method of controlling tensions of a steel strip in a continuous annealing furnace as set forth in claim 1, wherein said master speed hearth roll is controlled at a predetermined speed of rotation based on a line speed setting signal.

* * * * *

UNITED STATES PATENT AND TRADEMARK OFFICE

CERTIFICATE OF CORRECTION

PATENT NO. : 4,375,283

DATED : March 1, 1983

INVENTOR(S) : YUJI SHIMOYAMA, et al

It is certified that error appears in the above—identified patent and that said Letters Patent is hereby corrected as shown below:

On the title page:

At [75] inventors: after "Gunji Sakamoto", add

--Hideo Sunami and Munetoshi Suzuki--.

Signed and Sealed this

Third Day of May 1983

[SEAL]

*Attest:*

GERALD J. MOSSINGHOFF

*Attesting Officer*

*Commissioner of Patents and Trademarks*